US006916013B2

(12) United States Patent
Cardona

(10) Patent No.: US 6,916,013 B2
(45) Date of Patent: Jul. 12, 2005

(54) DEVICE FOR EXERTING PRESSURE ON A DOOR OR ON ANY OTHER VERTICAL PLANAR SURFACE

(75) Inventor: Yvan Cardona, Perpignan (FR)

(73) Assignee: Libervit, Perpignan (FR)

( * ) Notice: Subject to any disclaimer, the term of this patent is extended or adjusted under 35 U.S.C. 154(b) by 0 days.

(21) Appl. No.: 10/477,968

(22) PCT Filed: May 27, 2002

(86) PCT No.: PCT/FR02/01768

§ 371 (c)(1),
(2), (4) Date: Nov. 17, 2003

(87) PCT Pub. No.: WO02/096517

PCT Pub. Date: Dec. 5, 2002

(65) Prior Publication Data

US 2004/0149969 A1 Aug. 5, 2004

(30) Foreign Application Priority Data

Jun. 1, 2001 (FR) ..... 01 07219

(51) Int. Cl.[7] ..... B66F 3/24
(52) U.S. Cl. ..... 254/93 R; 254/89 H; 29/239
(58) Field of Search ..... 254/93 R, 89 H, 254/93 H, 134; 29/239

(56) References Cited

U.S. PATENT DOCUMENTS

| | | | | | |
|---|---|---|---|---|---|
| 4,270,733 | A | * | 6/1981 | DePue | 254/93 R |
| 4,762,304 | A | * | 8/1988 | Hill | 254/93 R |
| 4,783,053 | A | * | 11/1988 | Yirmiyahu et al. | 254/93 R |
| 5,489,083 | A | | 2/1996 | Rollor | |
| 5,810,333 | A | * | 9/1998 | Hickerson et al. | 254/93 R |
| 6,746,183 | B1 | * | 6/2004 | Sullivan | 405/272 |
| 2004/0149969 | A1 | * | 8/2004 | Cardona | 254/93 R |

FOREIGN PATENT DOCUMENTS

| | | |
|---|---|---|
| DE | 84 01 412.1 | 1/1984 |
| EP | 0 291 317 A2 | 5/1988 |
| GB | 2 236803 A | 4/1991 |

* cited by examiner

*Primary Examiner*—Lee D. Wilson
(74) *Attorney, Agent, or Firm*—Cohen, Pontani, Lieberman & Pavane

(57) ABSTRACT

A device for exerting thrust from external abutment points (1, 2) onto a door or any other vertical plane surface (3) such as a partition, the device being characterized in that it includes: a preferably hydraulic actuator (4), an intermediate soleplate (6), and a top abutment bar (7); the actuator having a moving rod ($4_1$), one end of which is fixed by being hinged ($6_3$), preferably releasably, to the intermediate soleplate (6); and the top abutment bar (7) being fixed preferably by being hinged ($6_3$), preferably releasably, at one of its ends to the intermediate soleplate (6).

25 Claims, 6 Drawing Sheets

DEVICE FOR EXERTING PRESSURE ON A DOOR OR ON ANY OTHER VERTICAL PLANAR SURFACE

PRIORITY CLAIM

This is a U.S. national stage of application No. PCT/FR02/01768, filed on 27 May 2002. Priority is claimed on that application and on the following application: Country: France, Application No.: 01/07219, Filed: 1 Jun. 2001.

The present invention relates to a device for exerting thrust from external abutment points on a door or on any other vertical plane surface such as a partition. The present invention also relates to a method of exerting thrust, preferably of at least 50 kilonewtons (kN) on a door or on any other vertical plane surface from external abutment points.

More particularly, the invention relates to a device for opening, as quickly as possible, by force, without impact, and silently, any type of door in a dwelling, or on industrial or other premises.

Such devices are designed to be used mainly either by emergency services such as fire departments or rescue services, or by special police brigades.

Devices of the "hydraulic crowbar" type are already known that comprise an electric motor, an engine, or a pneumatic motor associated with a hydraulic pump and with a reservoir of oil. The pressure source is connected, via a flexible duct, to a tool serving to push the door exclusively in the opening direction, once the tool has been engaged between the frame and the door, and to deliver a separating force by means of a hydraulic actuator.

Another tool also exists that makes it possible to open doors. That tool is made up of two actuators disposed perpendicularly to each other and secured together, namely:

a first actuator positioned horizontally and coming into abutment against the uprights of the door frame; and a second actuator positioned also horizontally but perpendicularly to the first actuator and secured thereto.

That tool makes it possible to exert thrust on the door exclusively in the opening direction and at the level of the lock.

The above-mentioned devices suffer from drawbacks that make them difficult to use, or even, in certain cases, totally unusable on current armored doors.

The majority of current armored doors are provided, inter alia, with metal angle bars disposed all the way around the door frame, making it impossible, under any circumstances, for any object to be slid between the door and the frame, thereby making the above-mentioned system of the hydraulic crowbar type totally unusable.

As for the other tool having two perpendicular actuators, the mere fact that it must be positioned horizontally midway between the floor and the top of the door frame in order to enable the actuator to exert its thrust force is unacceptable in certain types of work, in particular work by special police services who must be able to enter the room in question instantly as soon as the door is opened, and who instead find their path obstructed by the actuator disposed horizontally and transversely between the two vertical uprights of the door frame.

It is also observed that current armored doors, in particular those provided with 3 or 5 bolts, require a large amount of thrust in order to open them and, in many cases, since it has the door frame as its only point of abutment, the first horizontal actuator finds itself ejected by the thrust force exerted by the second actuator, thereby making the tool totally ineffective.

An object of the present invention is to provide a door-opening device and a door-opening method that are improved, in particular by remedying the drawbacks of the above-described current devices and methods.

More particularly, an object of the present invention is to provide a device making it possible to exert the thrust not only in the direction in which a door is designed to be opened, but also in its closing direction, unlike said tool having two perpendicular actuators.

To these ends, the present invention provides a device for exerting thrust from external abutment points on a door or on any other vertical plane surface such as a partition, said device being characterized in that it comprises:

a preferably hydraulic actuator, an intermediate soleplate, and a top abutment bar;

said actuator having a moving rod, one end of which is fixed by being hinged, preferably releasably, to said intermediate soleplate; and said top abutment bar being fixed preferably by being hinged, preferably releasably, at one of its ends to said intermediate soleplate.

The term "external abutment points" is used herein to designate points remote from said door or from said vertical plane surface.

Hinging the end of the moving rod to said intermediate soleplate makes it possible to dispose it so that it is inclined preferably by in the range 20° to 35° relative to the vertical, so that it is possible to exert thrust, preferably of at least 50 kN, on said intermediate soleplate when said intermediate soleplate is placed in abutment against said door or vertical plane surface, and when said actuator is in abutment against a bottom external abutment point, and preferably against the floor.

Similarly, hinging said top abutment bar to said intermediate soleplate makes it possible to dispose said bar substantially vertically so that its free end can be placed in abutment against a top external abutment point preferably constituted by the frame of said door of by a ceiling, or by a horizontal plane surface situated above said vertical plane surface. The term "free end" is used herein to designate that end of said bar which is not fixed to said intermediate soleplate.

In a preferred embodiment, the device of the invention further comprises a bottom soleplate, said actuator being fixed by being hinged, preferably releasably, at its other end to said bottom soleplate.

Hinging said actuator to said bottom soleplate thus makes it possible to dispose said bottom soleplate in abutment against said bottom external abutment point, and preferably against the floor, when said intermediate soleplate fixed to the end of the moving rod of said actuator is in abutment against the door or said vertical plane surface, said actuator being in a position in which it is inclined relative to the vertical.

The present invention also provides a method of exerting thrust, preferably of at least 50 kN, from external abutment points on a door or on any other vertical plane surface, said method being characterized in that a device of the invention is used.

In a particular implementation of the method of the invention, the following steps are implemented:

1) said actuator is disposed inclined at preferably 20° to 35° relative to the vertical; with said intermediate soleplate in abutment against said door or vertical plane surface, preferably in the vicinity of the lock or door handle, or of the hinges of said door;

said actuator being in abutment against a bottom external abutment point that is preferably constituted by the floor, preferably via a said bottom soleplate; and said top bar being in abutment against a top external abutment point, preferably a lintel of the frame of a door or a ceiling, or a horizontal plane surface situated above said vertical plane surface; and 2) the moving rod of said actuator is operated in extension so as to exert said thrust on said intermediate soleplate.

The term "bottom abutment point" is used herein to designate an abutment point situated lower than or at the same height as the abutment point via which the intermediate soleplate abuts against the door.

The various component elements of a device of the invention are fixed together releasably, i.e. the various component elements may be assembled together or else they may be separate, forming a kit that is ready to be assembled by fixing together the various component elements, namely said actuator, said intermediate and bottom soleplates, and said top abutment bar. This releasable mode of assembly also makes it possible to consider using only some of the component elements, in particular said actuator fixed in hinged and releasable manner to said intermediate and bottom soleplates, when a vertical external abutment surface is available against which said bottom soleplate at the end of said actuator can be applied, said actuator then being disposed substantially horizontally.

There follow other particular characteristics and advantages of the invention that may be taken separately or in combination:

Said actuator is a double actuator comprising an actuator body made up of a cylindrical chamber enclosing two moving rods adapted to exerting thrust in mutually opposite directions, the ends of said moving rods on the outside of said cylindrical chamber being connected by being hinged, preferably releasably, respectively to said intermediate soleplate and to said bottom soleplate.

Said top abutment bar is of adjustable length, and preferably made up of two telescopic tubes, the length of said abutment bar being adjustable by locking the relative position of said telescopic tubes. This characteristic makes it possible to adapt the device of the invention to fit doors of different heights, and to increase the compactness of the device once it is stowed away.

At its free end, said top abutment bar is provided with a shoe forming an angle bracket. The angle bracket is suitable for co-operating by coming into abutment with a right angle of the lintel of the frame of a said door.

Particularly advantageously, the device of the invention further comprises:

a hydraulic power unit delivering pressure that is preferably at least 250 bars, which unit is preferably mounted on a frame that can be carried on the back of an operator;

said hydraulic power unit being connected preferably via a single hose to a single-acting hydraulic actuator and also preferably via a handle making it possible to open and close hydraulic feed and return valves for feeding fluid to and returning it from said single-acting hydraulic actuator.

Insofar as the device of the invention requires only a short operating time, small batteries can be incorporated in it, thereby obtaining a portable device that is lightweight and compact.

Other characteristics and advantages of the present invention appear from the following detailed description given with reference to FIGS. 1 to 6, in which FIGS. 1A and 1B show a device of the invention as assembled and adapted to fit a closed door, in side view (FIG. 1A) and in front view (FIG. 1B);

Figure 4A:
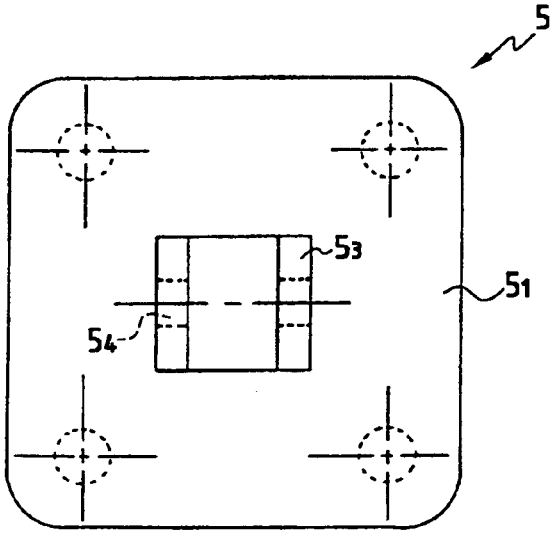
Figure 4C:
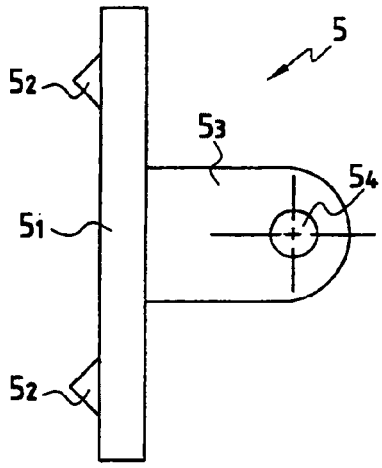
Figure 4B:
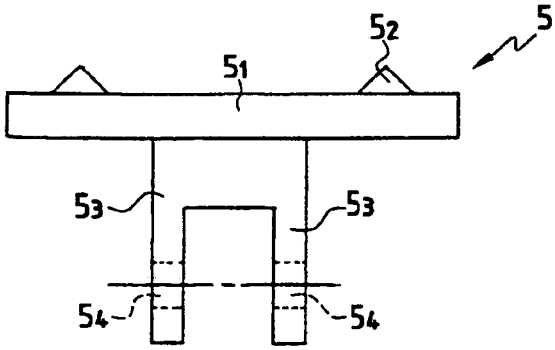
Figure 5B:
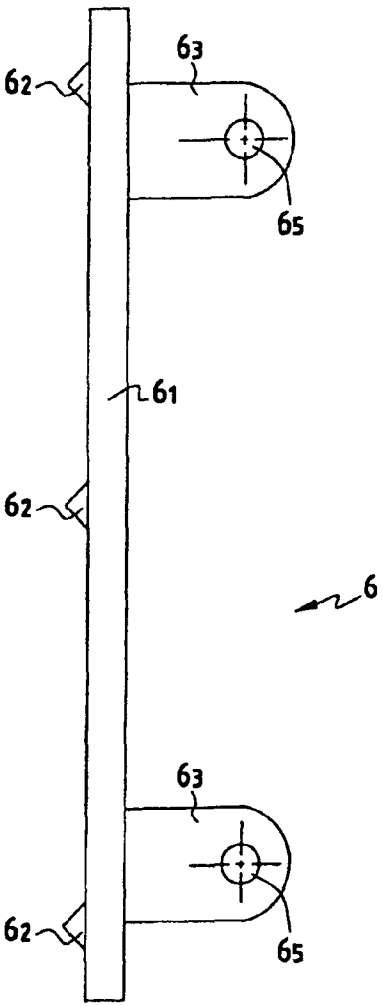
Figure 5A:
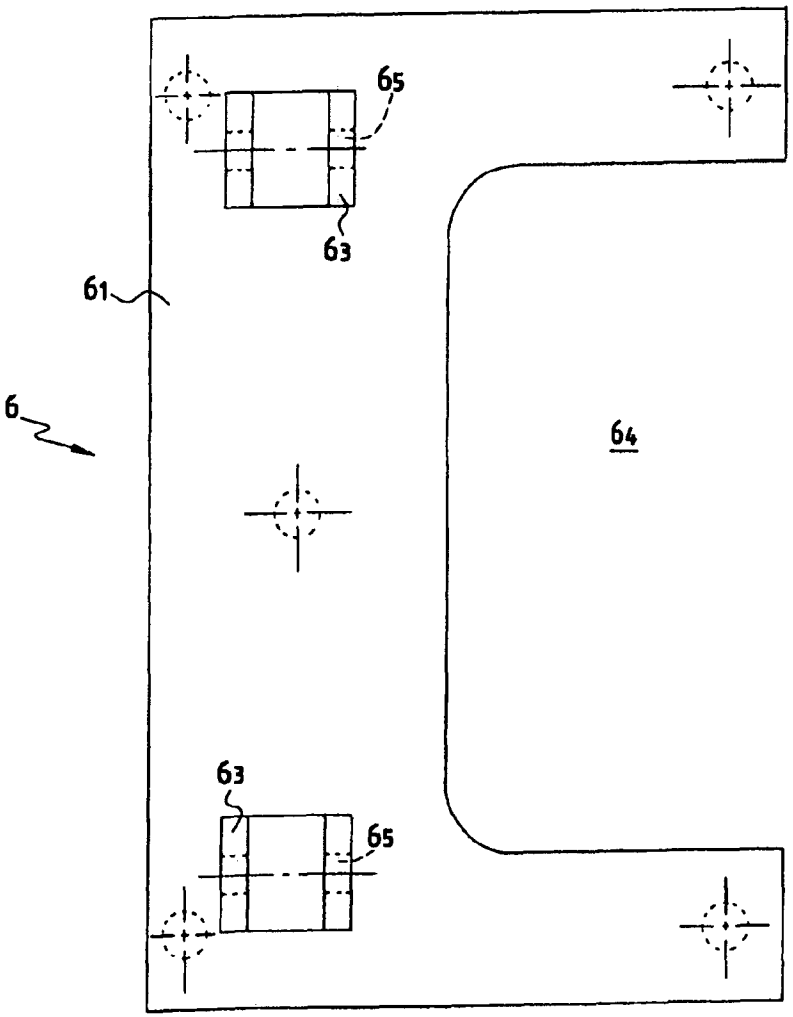
Figure 6A:
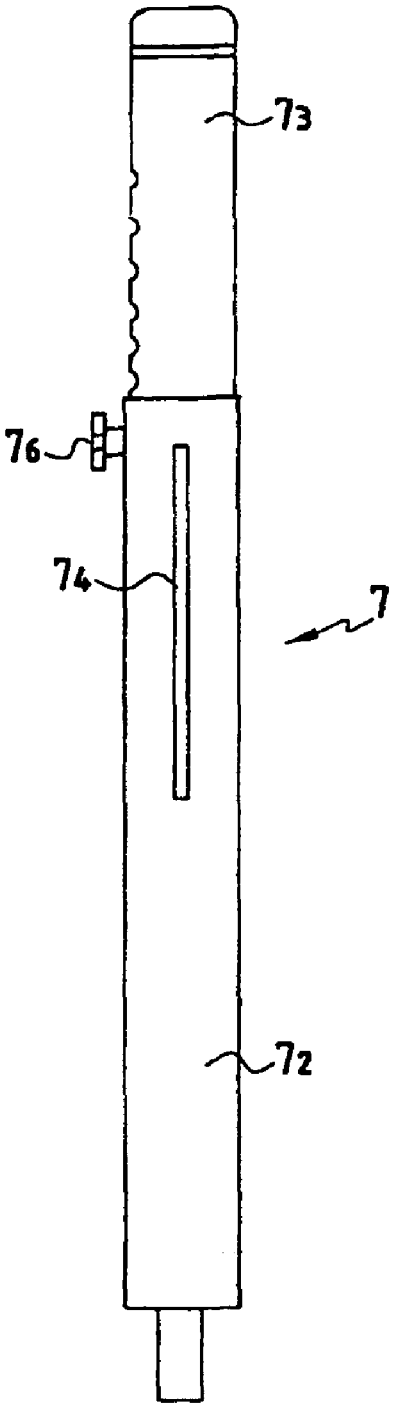
Figure 6B:
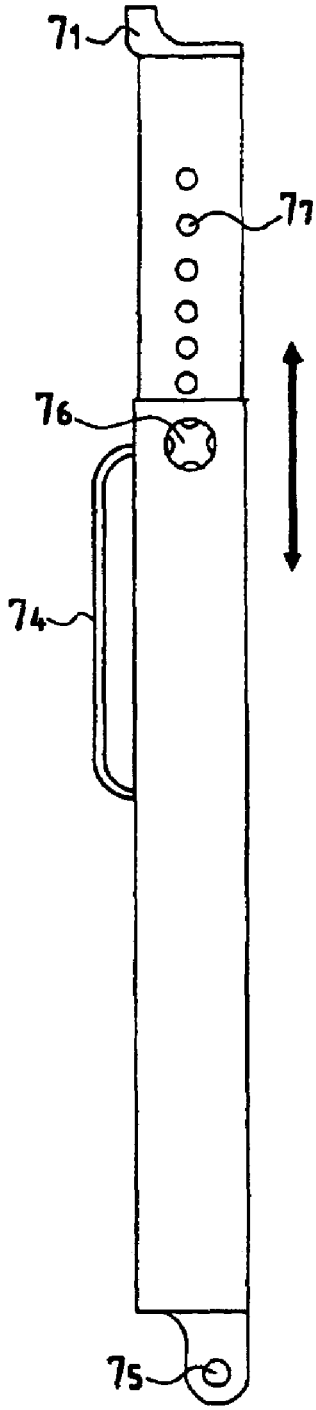

FIGS. 4A, 4B, and 4C are respectively a plan view (4A), a side view (4B), and a front view (4C) of a bottom soleplate;

FIGS. 5A and 5B are respectively a plan view (5A) and a side view (5B) of an intermediate soleplate; and FIGS. 6A and 6B are respectively a side view (6A) and a front view (6B) of a top abutment bar.

The device shown in the figures comprises:

a double actuator comprising a cylindrical actuator body $\mathbf{4}_3$ enclosing two moving rods $\mathbf{4}_1$, $\mathbf{4}_2$ suitable for exerting thrust directed in mutually opposite directions. Those ends of said moving rods $\mathbf{4}_1$, $\mathbf{4}_2$ which are on the outside of said cylindrical chamber are connected in hinged and removable manner respectively to said intermediate soleplate 6 and to said bottom soleplate 5.

As shown in FIG. 4, said bottom soleplate 5 comprises a flat support $\mathbf{5}_1$, one face of which serves to come into abutment against a bottom abutment point 1, preferably the floor, and is provided with non-slip elements, preferably hard spikes $\mathbf{5}_2$, and the other face of said flat support is provided with hinge means $\mathbf{5}_3$, $\mathbf{5}_4$, $\mathbf{4}_5$ for hinging said actuator 4 to said bottom soleplate 5.

FIG. 6 shows said top abutment bar 7 of adjustable length, made up of two telescopic tubes $\mathbf{7}_2$, $\mathbf{7}_3$ whose length is adjustable by locking $\mathbf{7}_6$ their relative position, in particular by means of a locking peg $\mathbf{7}_6$ co-operating with bores $\mathbf{7}_7$ in the top tube $\mathbf{7}_3$, the top tube $\mathbf{7}_3$ being slidably received in the bottom tube $\mathbf{7}_2$.

FIG. 6 also shows a carrying handle $\mathbf{7}_4$, and a shoe $\mathbf{7}_1$ in the form of an angle bracket at the free end of said abutment bar, and suitable for co-operating coming into abutment against a right angle of a door frame lintel in particular.

FIGS. 5A and 5B show said intermediate soleplate 6 comprising a flat support $\mathbf{6}_1$, one face of which serves to come into abutment against said door or vertical plane surface, and is provided with non-slip elements constituted by hard spikes $\mathbf{6}_2$, and the other face of said flat support is provided with hinge means $\mathbf{6}_3$, $\mathbf{6}_4$, $\mathbf{4}_5$, $\mathbf{7}_5$ for hinging said actuator 4 to said top abutment bar 7.

As shown in FIG. 5, said intermediate soleplate 6 comprises a flat support $\mathbf{6}_1$ that is recessed to form a recessed zone $\mathbf{6}_4$ making it possible to dispose said intermediate soleplate 6 around an obstacle formed by a lock or a door handle $\mathbf{3}_1$. This configuration is advantageous because it guarantees that the door opens by avoiding merely pushing in center of the panel constituting the door without fully opening the door, and thus leaving a passageway that is too small for people to pass through.

Said intermediate soleplate 6 and said bottom soleplate 5 comprise flat supports or plates $\mathbf{5}_1$, $\mathbf{6}_1$ and hinge means $\mathbf{5}_3$, $\mathbf{5}_4$, $\mathbf{6}_3$; $\mathbf{6}_4$ constituted by forks $\mathbf{5}_3$, $\mathbf{6}_3$ on one face of each of the flat supports $\mathbf{5}_1$, $\mathbf{6}_1$, the forks releasably receiving retractable studs (not shown) forming hinge pins in bores $\mathbf{5}_4$, $\mathbf{6}_5$, $\mathbf{7}_5$, $\mathbf{4}_5$ in said forks, and in said ends of said top abutment bar 7 and/or of said actuator 4, thus enabling them to be hinged to said soleplates 5, 6.

More particularly, the bore $4_5$ in the end of the first moving rod $4_1$ of the hydraulic actuator co-operates with bores $6_5$ in the forks $6_3$ on the intermediate soleplate 6 and with a first retractable stud (not shown) inserted through said bores $6_5$ in the forks and through said bore $4_5$ in the end of said first moving rod $4_1$ of the actuator, thereby making it possible to hinge said actuator to swing pivotally about the pin constituted by said first stud, in particular while said intermediate soleplate 6 is being put in place in abutment against a said door 3 and said actuator 4 is being positioned so that it is inclined at 20° to 35° relative to the vertical.

Similarly, the bore $4_5$ in the end of the second moving rod $4_2$ of said actuator co-operates with bores $5_4$ in the forks $5_3$ of the bottom soleplate 5, and with a second retractable stud (not shown) inserted through said bores $5_4$ in the forks $5_3$ on the bottom soleplate $4_3$ and in the end of said second moving rod $4_2$ thereby making it possible to hinge said actuator to swing pivotally about the pin constituted by said second stud, in particular while said bottom soleplate 5 is being put in place in abutment against the floor 1.

Similarly, the bore $7_5$ at the bottom end of said abutment bar 7 co-operates with the bores $6_5$ in the forks $6_3$ on the intermediate soleplate 6 and with a third retractable stud (not shown) inserted through said bores $7_5$, $6_5$, thereby making it possible to hinge said top abutment bar to swing pivotally about the pin constituted by said third stud while said intermediate soleplate 6 is being put in place in abutment against the door 3.

Naturally, these means for hinging the actuator 4 and the abutment bar 7 relative to said soleplates 6, 5 are described merely by way of illustration, it being possible for other hinge means to be implemented without going beyond the ambit of the present invention.

Figure 3B:
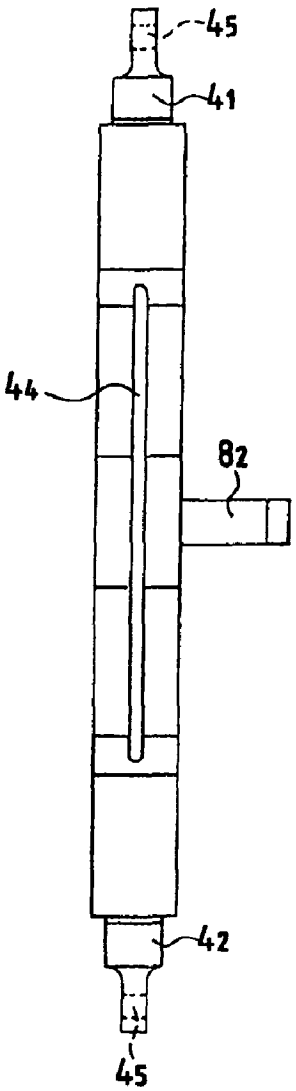
FIGS. 3A and 3B are a side view (FIG. 3A) and a front view (FIG. 3B) of a hydraulic actuator.
Figure 3A:
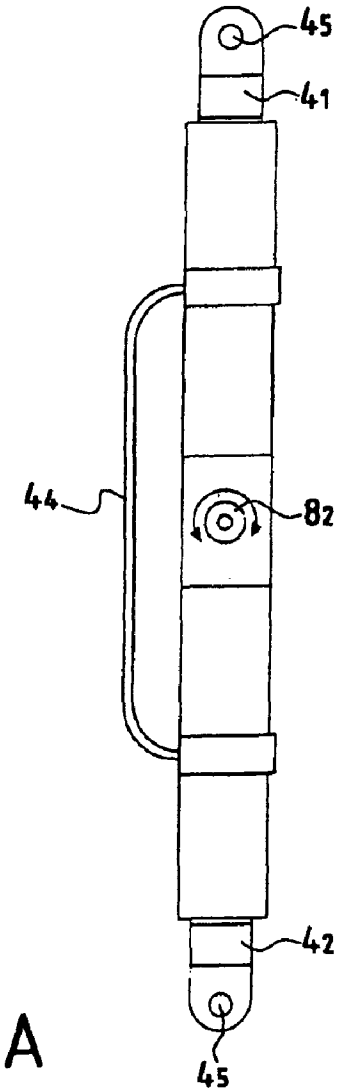

FIG. 3 shows said hydraulic actuator with an operating handle $8_2$ and with a carrying handle $4_4$.

The hydraulic actuator 4 is a single-acting actuator provided with a single hose $8_1$ enclosing the hydraulic fluid duct and the electrical connections. Said hose $8_1$ is connected to said actuator via an operating handle $8_2$ which, when turned, starts up the hydraulic power unit (not shown) at the end of the hose. Such a method and device for controlling and feeding a hydraulic actuator are described in French Patent Application FR 94/07680 (published under No. 2 721 359). Said handle $8_2$, in combination with the hose $8_1$ connecting said hose to a hydraulic fluid source, forms an electrical link between said source and at least one contactor, and makes it possible:

by turning the handle $8_2$, to close said contactor for starting up the fluid source, the fluid of which-thus being put under pressure;

to feed fluid via a feed hose $8_1$ and via said handle $8_2$ which is connected to said feed hose $8_1$ to the chamber of said actuator that is situated on the appropriate sides of the moving pistons to deploy the rods of the actuator;

to stop moving the rod of the actuator and the pressurized fluid source, by releasing the handle, which returns to a neutral rest position;

to open a return valve for returning the fluid that has filled the chamber of the actuator by turning the handle in the direction opposite to the direction in which it was turned previously; and to remove said fluid by pressing with resilient means on the opposite sides of the pistons so they move in the direction opposite to the direction in which they moved previously.

Preferably, the chamber of the other side of the piston relative to the chamber receiving said pressurized fluid is filled with compressed gas which thus maintains a bearing pressure on the corresponding side of the piston. However, it is possible, without going beyond the ambit of the present invention, to use double-acting actuators with two hydraulic fluid feed hoses that can deliver energy respectively for deploying and for returning the moving rods.

Figure 1B:
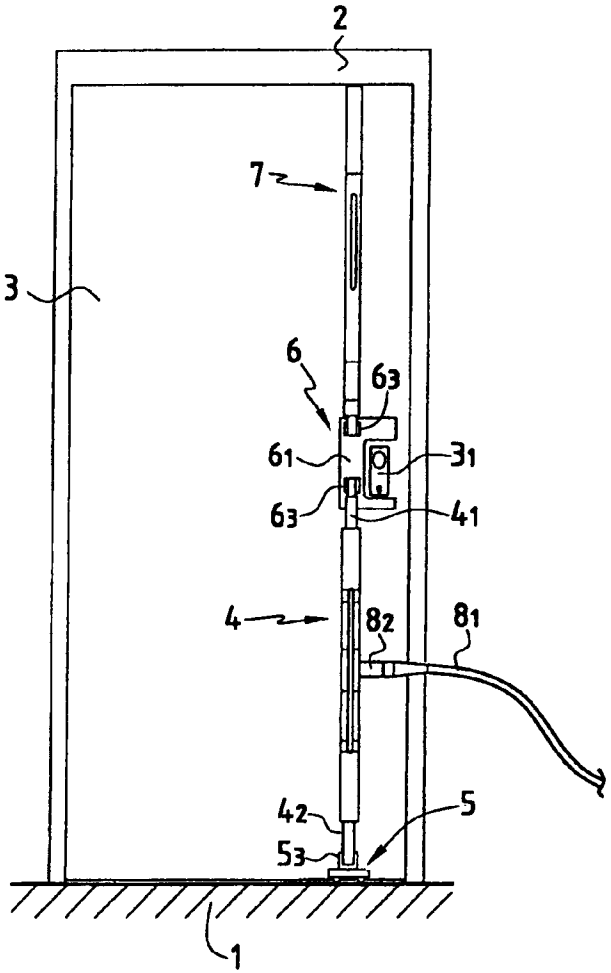
Figure 1A:
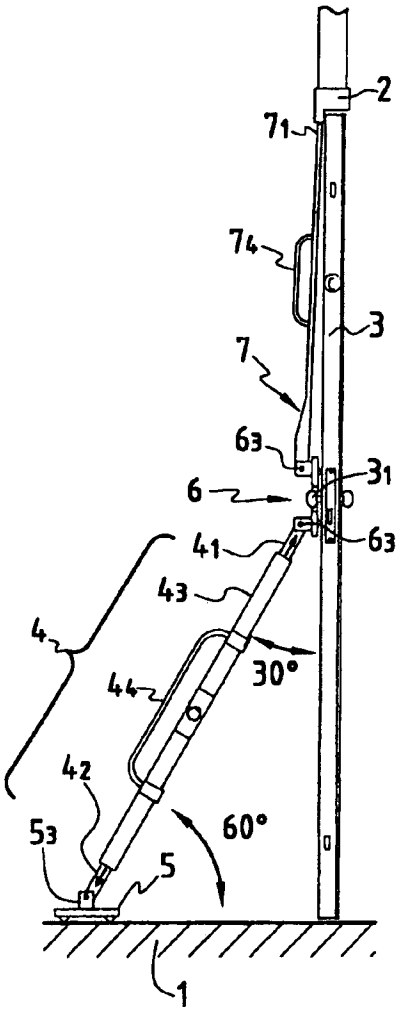
Figure 2:
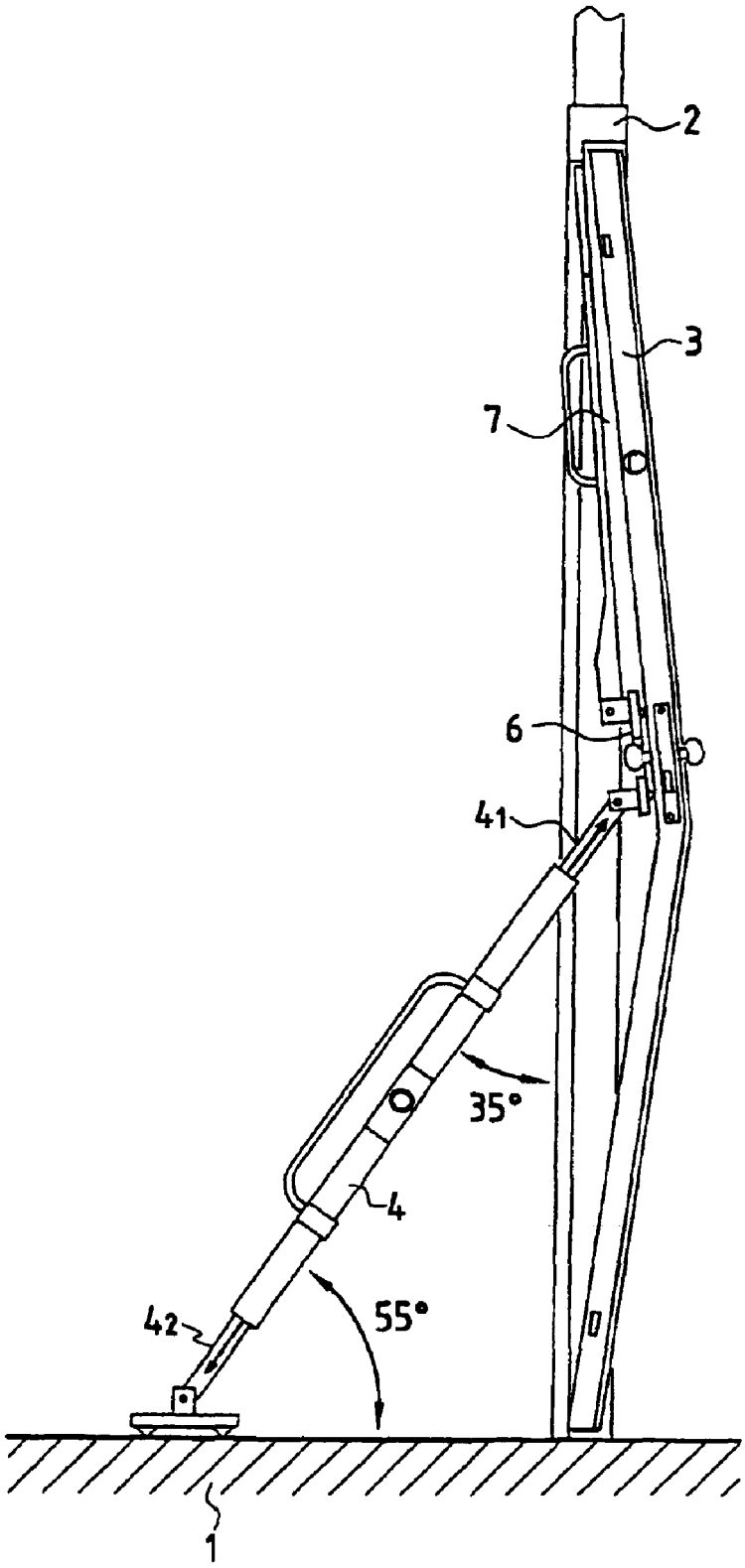
FIG. 2 shows a side view of a device of the invention after the hydraulic actuator has been actuated, and after the door has been opened.

For using the device of the invention as shown in FIGS. 1 and 2, the following successive steps are implemented:

the top abutment bar is positioned in abutment under and against the lintel of the frame 2 of the door 3;

the intermediate soleplate 6 is positioned in abutment against the door 3 around the lock $3_1$;

the bottom soleplate 5 of the hydraulic actuator 4 is positioned in abutment against the floor 1, and the moving rods of the actuator 4 are deployed so that the actuator takes up an inclination of about 30°. Once the device is in place, the grip elements constituted by the hard steel spikes $6_2$ and $5_2$ on the intermediate soleplate 6 and on the bottom soleplate 5 make it possible to stabilize the positioning of the device.

Once the device is in place, the moving rods 41 and 42 of said actuator are actuated in extension so that they exert thrust of at least 50 kN on respective ones of said intermediate and bottom soleplates 6, 5.

Thrust is exerted on an armor-plated door to force it open by exerting thrust on said intermediate soleplate 6 until the inclination of said actuator 4 is increased by an angle of at least 3°, and preferably in the range 5° to 20°. The actuator is deployed and transmits its force via the top abutment bar 7 to the to top of the frame 2 of the door or to the ceiling. The resistance opposed by the top abutment point and by the lintel 2 of the frame makes it possible to obtain a horizontal thrust at the intermediate soleplate 6, and makes it possible to open the door.

Use of a hydraulic actuator is described, but the actuator may also be put under pressure by means of an electrically-driven, engine-driven, pneumatic, or manual pump.

For current armored doors, in particular doors provided with 3 or 5 bolts, it has been observed that, when the device is situated around the locks, said locks give way as from an actuator thrust of about 50 kN, obtained with a hydraulic pressure of about 250 bars, and generating an additional actuator inclination of 15°, as shown in FIG. 2. This operation takes place in a few seconds, the actuator does not require high energy, and can operate with a hydraulic power unit not exceeding 18 kilograms (kg) in weight and that can be adapted to fit a frame that can be carried on the back of one person.

What is claimed is:

1. A device for exerting thrust from external abutment points onto a vertical surface, said device comprising:

an actuator having a first moving rod with at least a first end;

an intermediate soleplate; and a top abutment bar having at least a first end;

said first end of said first moving rod being hingedly fixed to said intermediate soleplate; and said first end of said top abutment bar being fixed to said intermediate soleplate.

2. A device according to claim 1, further comprising a bottom soleplate;

wherein said actuator includes a second end, and said actuator is hingedly fixed at said second end thereof to said bottom soleplate.

3. A device according to claim 2, wherein said actuator is a double actuator comprising a second moving rod and an actuator body made up of a cylindrical chamber enclosing said first moving rod and said second moving rod, each of said first and second moving rods having at least a first end, and said first and second moving rods being adapted to exert thrust in opposite directions;

wherein said first end of said first moving rod is disposed on the outside of said cylindrical chamber and is hingedly connected to said intermediate soleplate; and wherein said first end of said second moving rod is hingedly connected to said bottom soleplate.

4. A device according to claim 3 wherein said first end of said first moving rod is releaseably hinged to said intermediate soleplate and said first end of said second moving rod is releaseably hinged to said bottom soleplate.

5. A device according to claim 2, wherein said bottom soleplate comprises a flat support having first and second faces, said first face of which serves to come into abutment against a bottom abutment point and is provided with non-slip elements, said second face thereof being provided with hinge means for hingedly connecting said actuator to said bottom soleplate.

6. A device according to claim 5 wherein said bottom abutment point is a floor.

7. A device according to claim 2, wherein said intermediate soleplate and said bottom soleplate each include:

a flat support having at least a first face; and a fork on said first face of each of said flat supports, each of said forks having a bore therein;

wherein each of said first and second hinges includes at least one of said forks; and wherein said bores are adapted to releasably receive a stud therein, one of said studs serving as a hinge pin in a hinge used to fix at least one of a) said intermediate soleplate to at least one of said moving rod and said top abutment bar, and b) said bottom soleplate to said actuator.

8. A device according to claim 7, further comprising:

a hydraulic power unit delivering pressure, said hydraulic power unit being mounted on a frame that can be carried on the back of an operator;

wherein said hydraulic power unit is connected via a single hose to a single-acting hydraulic actuator and also via a handle making it possible to open and close hydraulic feed and return valves for feeding fluid to and returning fluid from said single-acting hydraulic actuator.

9. A device according to claim 8 wherein said hydraulic power unit delivers pressure of at least 250 bars.

10. A device according to claim 7 wherein said studs form hinged pins through bores in said forks and in said first ends of said top abutment bar and in said actuator.

11. A device according to claim 2 wherein said second end of said actuator is releasably hinged to said bottom soleplate.

12. A device according to claim 1, wherein said top abutment bar is of adjustable length, and includes two telescopic tubes, the length of said abutment bar being adjustable by locking the relative position of said telescopic tubes.

13. A device according to claim 1, wherein said top abutment bar includes a second end opposed to said first end thereof, said second end of said top abutment bar having a shoe forming an angle bracket.

14. A device according to claim 1, wherein said intermediate soleplate comprises a flat support having first and second faces, said first face being configured to abut against said vertical surface, and including non-slip elements; and wherein said second face of said intermediate soleplate is provided with hinge means for hingedly connecting said actuator to said top abutment bar.

15. A device according to claim 14 wherein said non-slip elements are hard spikes.

16. A device according to claim 1, wherein said intermediate soleplate comprises a recessed flat support forming a recessed zone making it possible to dispose said intermediate soleplate around an obstacle.

17. A device according to claim 1 wherein said actuator is a hydraulic actuator.

18. A device according to claim 1 wherein said first end of said first moving rod is releasably hinged to said intermediate soleplate.

19. A device according to claim 1 wherein said first end of said top abutment bar is hinged to said intermediate soleplate.

20. A device according to claim 19 wherein said first end of said top abutment bar is releasably hinged to said intermediate soleplate.

21. A method of exerting thrust from external abutment points onto a vertical surface through the use of a device which includes an actuator, an intermediate soleplate and a moving rod, the method comprising the steps of:

disposing said actuator proximate to said vertical surface at an angle of from about 20° to about 35° relative to vertical;

abutting said intermediate soleplate against said vertical surface;

abutting said actuator against a bottom external abutment point;

abutting said top bar against a horizontal plane surface situated above said vertical plane surface;

extending said actuators; and exerting force on said intermediate soleplate through said moving rod of said actuator.

22. A method according to claim 21, wherein thrust is exerted on an armor-plated door in order to force the opening thereof by exerting thrust on said intermediate soleplate until the inclination of said actuator is increased by an angle of at least 3°.

23. A method according to claim 22, wherein the inclination of said actuator is increased by an angle in the range of from about 50 to about 20°.

24. A method of exerting thrust from external abutment points onto a vertical surface by use of a device, said device comprising an actuator having a moving rod with at least a first end and a hinge mounted on said first end of said moving rod, an intermediate soleplate, and a top abutment bar having at least a front end, said first end of said moving rod being hingedly fixed to said intermediate soleplate by said first hinge, and said first end of said top abutment bar being fixed to said intermediate soleplate, said method comprising the steps of:

disposing said intermediate soleplate proximate said vertical surface; and actuating said actuator to exert thrust on said intermediate soleplate.

25. A method according to claim 24 wherein said thrust is at least 50 kN.

* * * * *